US005425186A

United States Patent [19]

Hoyt

[11] Patent Number: 5,425,186

[45] Date of Patent: Jun. 20, 1995

[54] OVERSHOE WITH AN ACCORDIAN TYPE SOLE

[76] Inventor: David Hoyt, 4170 Motor Ave., Culver City, Calif. 90230

[21] Appl. No.: 228,084

[22] Filed: Apr. 15, 1994

[51] Int. Cl.[6] ..... A43B 3/26; A43B 3/20

[52] U.S. Cl. ..... 36/97; 36/7.1 R; 36/7.3; 36/4

[58] Field of Search ..... 36/100, 97, 7.1 R, 7.3, 36/4, 102, 87, 7.4, 32 R, 59 C

[56] References Cited

U.S. PATENT DOCUMENTS

| | | | |
|---|---|---|---|
| 4,497 | 5/1846 | Vetter | 36/97 |
| 2,252,315 | 8/1941 | Doree | 36/97 |
| 3,026,635 | 3/1962 | Slade | 36/7.3 |
| 4,489,509 | 12/1984 | Libit | 36/7.3 |
| 4,944,099 | 7/1990 | Davis | 36/97 |
| 5,033,209 | 7/1991 | Bathurst et al. | 36/7.3 |

*Primary Examiner*—Steven N. Meyers
*Assistant Examiner*—Marie Denise Patterson

[57] ABSTRACT

An overshoe includes an upper section having an entryway into which a shoe is inserted, a heel (14), and a sole (12) spaced from the heel (14), with the heel (14) and sole (12) having a common longitudinal axis and common interior and exterior surfaces. The upper section, heel (14) and sole (12) are unitary structure formed from an elastic polymeric material to provide an overshoe which stretches lengthwise along the longitudinal axis of the heel (14) and sole (12) to fit a plurality of different size shoes. The heel (14) and sole (12) each have an accordian-like configuration with a plurality of spaced apart bars in a row separated from each other by channels on the exterior surfaces of said sole (12) and heel (14) , and a plurality of parallel ridges (22) in a row separated by recesses (26) on the interior surfaces of the sole (12) and heel (14) . Each ridge is directly opposite a bar (18). The bars (18), channels, ridges (22) and recesses (26) each extend substantially at right angle to the longitudinal axis across the width of the sole (12) or heel (14) as the case may be.

14 Claims, 2 Drawing Sheets

10
12
14
16
18
18a
20
30
32

FIG. 4
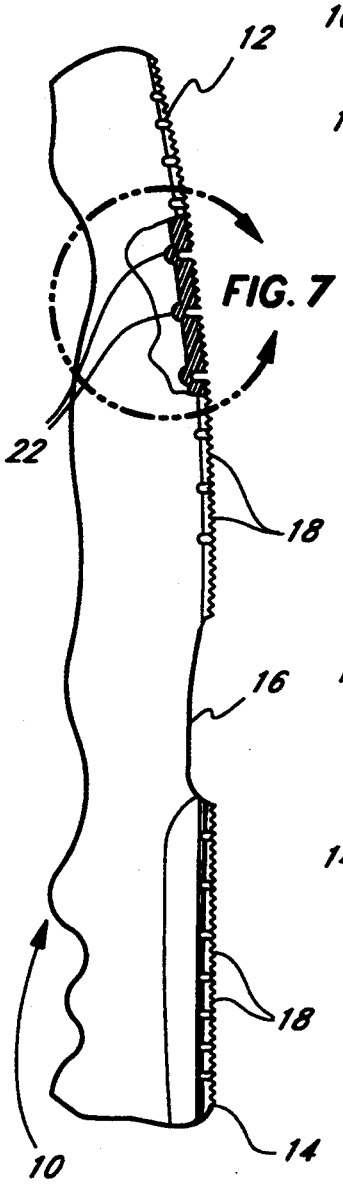
FIG. 5
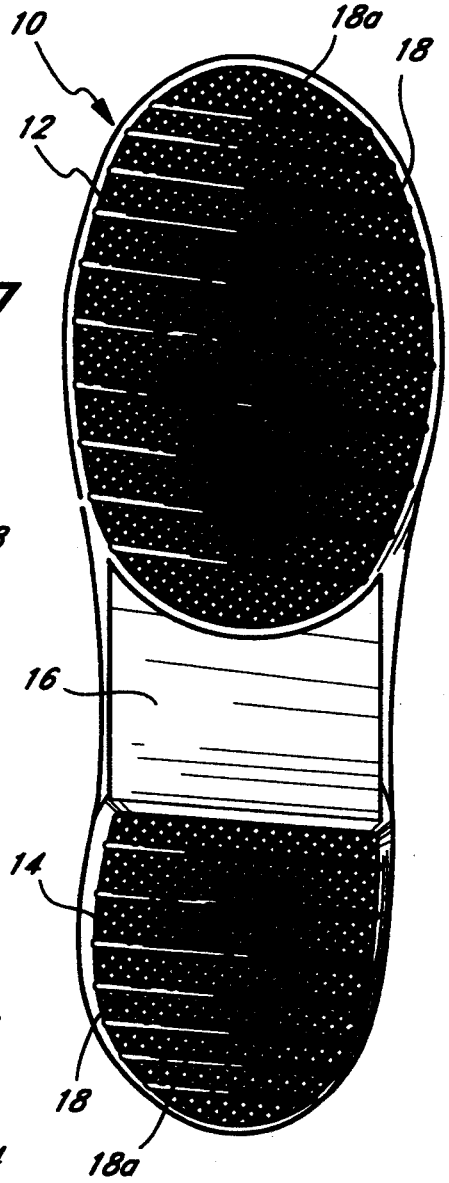
FIG. 6
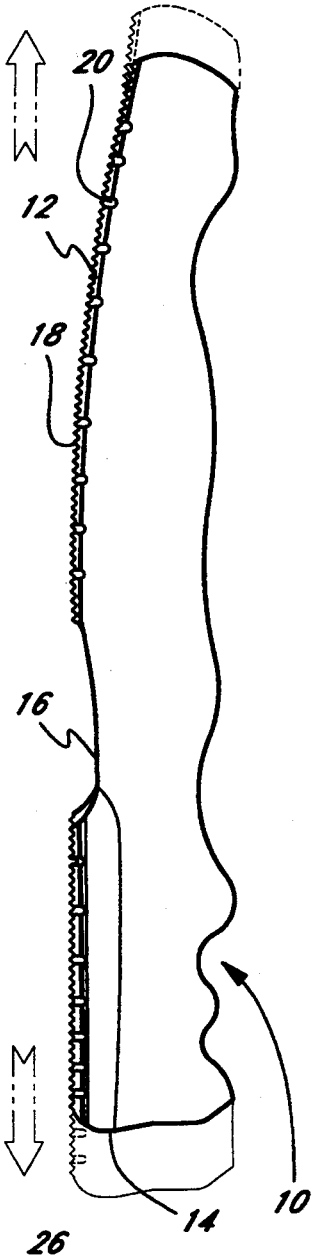
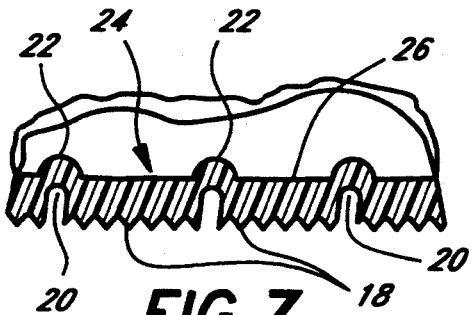
FIG. 7
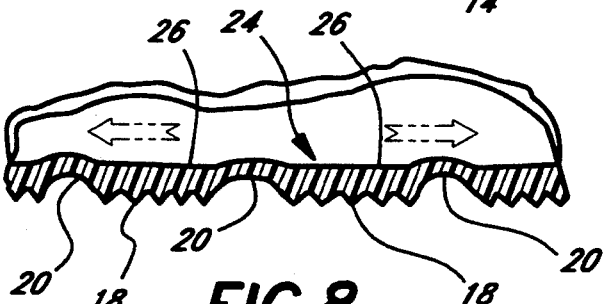
FIG.8

OVERSHOE WITH AN ACCORDIAN TYPE SOLE

BACKGROUND OF THE INVENTION

1. Field of the Invention

This invention relates to an overshoe, in particular, an overshoe that will fit over several different sized shoes.

2. Background Discussion

Overshoes are commonly used to protect both men and women's' shoes. Typically, they are made out of an elastic material such as polyvinylchloride and have an upper section which is integral with the sole and heel of the overshoe. The upper section has an entryway into which the shoe fits, and the overshoe has the ability to stretch and fit over the shoe.

SUMMARY OF THE INVENTION

It is the objective of this invention to provide an overshoe which will fit a wide variety of different sized shoes.

The overshoe of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its advantages, which include simplicity of manufacture, style, and, most importantly, stretchability that enables the overshoe to fit a wide variety of different sized shoes.

The first feature of the overshoe of this invention is that it has a upper section having an entryway into which a shoe is inserted and a sole and heel with a common longitudinal axis and common exterior and interior surfaces. The upper section, sole and heel are a unitary structure formed from an elastic, polymeric material to provide an overshoe which stretches lengthwise along the longitudinal axis of the sole and heel to fit several different size shoes. The preferred polymeric material is polyvinylchloride, from which the overshoe is easily molded using conventional molding techniques. An unpigmented material is preferred, so that the overshoe will be translucent.

The second feature is that the sole and the heel each have an accordian-like configuration, where there are, on the exterior surface, a plurality of spaced apart bars in a row separated from each other by channels, and, on the interior surface, a plurality parallel ridges in a row separated by recesses. Each ridge is directly opposite a channel and each recess is directly opposite a bar. The bars, channels, ridges, and recesses each extend substantially at a right angle to the longitudinal axis across the width of the sole or heel, as the case may be. The thickness of the sole or heel, as the case may be, across each bar and recess is greater than 0.080 inch but less than 0.140 inch, and the thickness of the sole or heel, as the case may be, across each channel and ridge is greater than 0.025 inch but less than 0.100 inch. Each bar has a width of from $\frac{1}{8}$ to $\frac{1}{2}$ inch, and each channel has a width of from $\frac{1}{8}$ to $\frac{1}{4}$ inch. The bars preferably have serrated surfaces and rectangular configurations. The bars vary in width, with wider bars being located in a central portion of the sole. The widths of the channels are essentially the same.

DESCRIPTION OF THE DRAWING

The preferred embodiment of this invention, illustrating all its features, will now be discussed in detail. This embodiment depicts the novel and non-obvious method and device of this invention shown in the accompanying drawing, which is for illustrative purposes only. This drawing includes the following figures (FIGS.), with like numerals indicating like parts:

FIG. 4 is a fragmentary side view partially in section of the overshoe of this invention.

FIG. 5 is a plan view of the overshoe of this invention, looking down at the sole and heel of the shoe.

FIG. 6 is a fragmentary side view with the shoe being stretched, with the stretched position of the overshoe shown in dotted lines.

FIG. 7 is an enlarged, cross section view of the section depicted in FIG. 4 along lines 7—7.

FIG. 8 is a view similar to FIG. 7 except stretched to show how the sole changes shape when placed in tension.

DESCRIPTION OF THE PREFERRED EMBODIMENT

Figures 1, 2, 3:
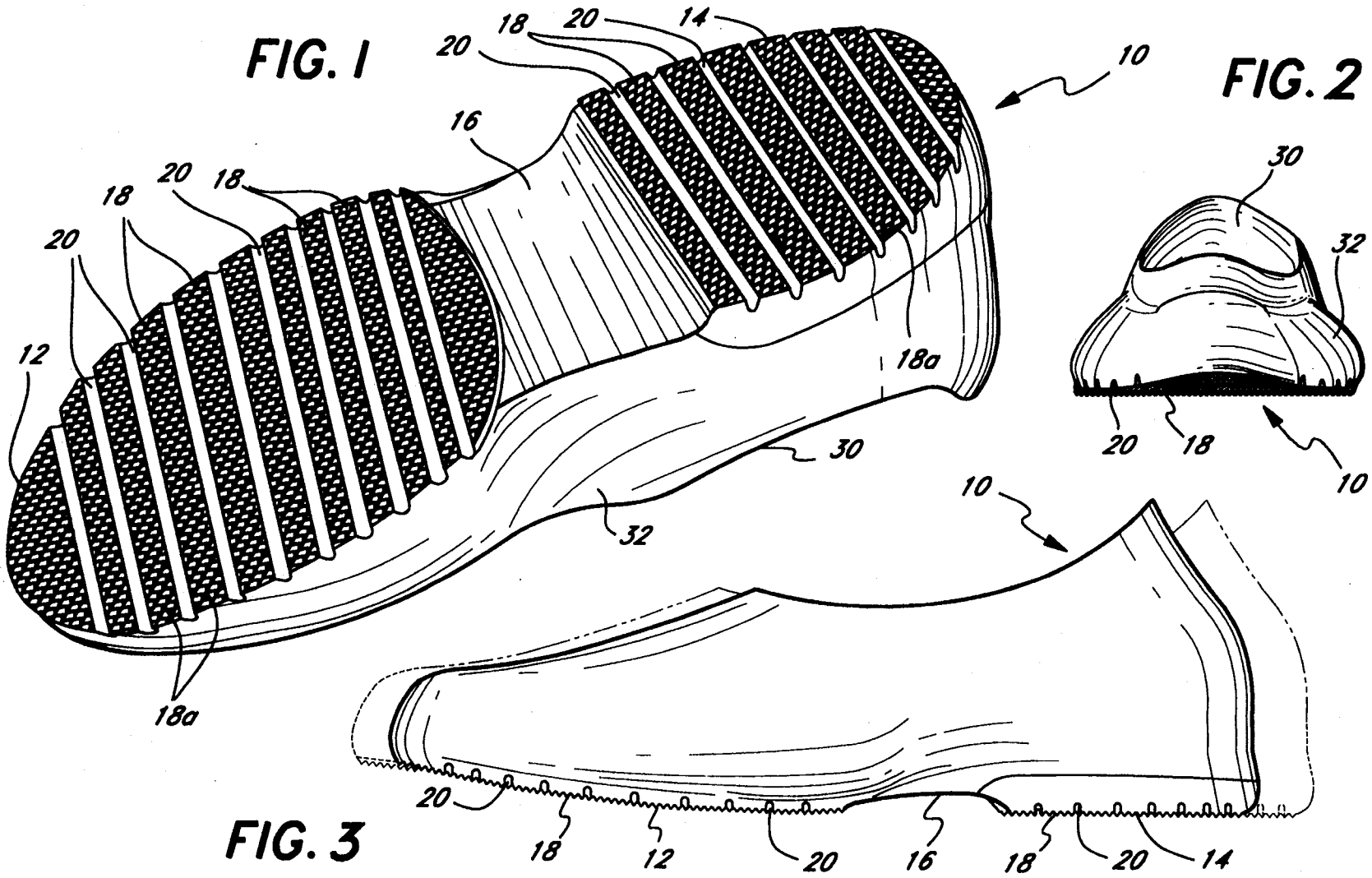
FIG. 1 is a perspective view of the overshoe of this invention looking at the bottom of the overshoe.
FIG. 2 is a front elevational view of the overshoe of this invention.
FIG. 3 is a side elevational view of the overshoe of this invention.

As best shown in FIGS 1–3, the overshoe 10 of this invention is an integral structure made of a polymeric material such as polyvinylchloride (PVC). Preferably an unpigmented material is used so that the overshoe 10 is clear or translucent. Typically, 80 to 140 parts of plasticizer to 100 parts of PVC is used, and the preferred material comprises about 122 parts of plasticizer to 100 parts of PVC. The preferred PVC is sold by Oxychemical, Inc. of New Jersey under the designation Oxy 1755. There are a wide variety of plasticizers that may be used, but the preferred plasticizers are (1) bis(2-ethylhexyl) terephthalate, (2) dioctyl terephthalate, or (3) di-(2-ethylhexyl) terephthalate. Eastman Chemical Corporation sells suitable plasticizer under the trademark Kodaflex. The PVC with the plasticizer is elastic and stretches, having an elongation of up to a maximum of 100% without exceeding its elastic limit.

In accordance with this invention, the sole 12 and heel 14 of the overshoe 10 have an accordion-like configuration to facilitate stretching to accommodate shoes of several different sizes. The sole 12 and heel 14 are separated by an arch section 16. Both the sole 12 and heel 14 include a plurality of bars 18 which extend across the width of the sole 12 and heel 14, respectively. Each bar 18 has, preferably, a serrated surface 18a and each bar is separated from an adjacent bar by a channel 20. Typically, the bars 18 near the central portion of heel 14 and sole 12 have a width slightly greater that the bars 18 near the ends of the heel 14 and sole 12. Typically, with the overshoe 10 unstreached: the central bars 18 have a width of $\frac{3}{8}$ inch and the bars 18 near the edge have a width of $\frac{1}{8}$ inch; the channels 20 each have a width of approximately an $\frac{1}{8}$ inch and a depth as measured from the serrated surface **18*a* of an adjacent bar 18** of approximately an $\frac{1}{8}$ inch.

As best shown in FIGS. 4, 7, and 8, there are a plurality of ridges 22 extending across the width of the common interior surface 24 of the sole 12 and heel 14. Each ridge 22 is separated from an adjacent ridge by a recesses 26. Each ridge 22 is directly opposite a channel 20, and each recess 26 is directly opposite a bar 18. The thickness across a ridge 22 and a channel 20 typically is 0.060 inch and the thickness across a recess 26 and bar 18 is typically 0.125 inch.

This accordion-like structure of the sole 12 and heel 14 enables both the sole 12 and heel 14 to elongate easily to accommodate a larger sized shoe than the nominal size of the overshoe 10. This ability to elongate or stretch is best depicted in FIG. 8. The ridges 22 provide excess material that allows the sole 12 and heel to easily stretch to accommodate larger size shoes when the shoe is inserted into an entryway 30 in the upper section 32 of the overshoe 10.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

I claim:

1. An overshoe, including a upper section having an entryway into which a shoe is inserted and a sole with a longitudinal axis having an exterior surface and an interior surface, said sole having a forefoot ground engaging portion and a heel ground engaging portion separated by an arch portion, said upper section and sole being a unitary structure formed from an elastic polymeric material to provide an overshoe which stretches lengthwise along the longitudinal axis of the sole to fit a plurality of different size shoes, said forefoot portion having an accordian-like configuration, where on the exterior surface of said forefoot portion, there are a plurality of spaced apart bars in a row separated from each other by channels, and, where on the interior surface of said sole, there are a plurality parallel ridges in a row separated by recesses, each ridge being directly opposite a channel and each recess being directly opposite a bar, said bars and channels and said ridges and recesses each extending substantially at a right angle to the longitudinal axis of the sole across the width of the sole, with the thickness of the sole across each bar and recess being greater than 0.080 inch but less than 0.140 inch, and the thickness of the sole across each channel and ridge being greater than 0.025 inch but less than 0.100 inch, each bar having a width of from $\frac{1}{8}$ to $\frac{1}{2}$ inch, and each channel having a width of from $\frac{1}{8}$ to $\frac{1}{4}$ inch.

2. The overshoe of claim 1 where the bars have serrated surfaces.

3. The overshoe of claim 2 where the bars have rectangular configurations.

4. The overshoe of claim 1 where the polymeric material is polyvinylchloride.

5. The overshoe of claim 1 where the widths of the bars vary in width, with wider bars being located in a central portion of the forefoot portion.

6. The overshoe of claim 1 where the widths of the channels are essentially the same.

7. The overshoe of claim 1 where the polymeric material is translucent.

8. An overshoe, including a upper section having an entryway into which a shoe is inserted, a sole comprising a ground contacting heel portion and a ground contacting forefoot portion separated by an arch portion, with a heel and forefoot portion having a common longitudinal axis and common interior and exterior surfaces, said upper section, heel and forefoot portion being a unitary structure formed from an elastic polymeric material to provide an overshoe which stretches lengthwise along the longitudinal axis of the heel and forefoot portion to fit a plurality of different size shoes, said heel and forefoot portion each having an accordian-like configuration, where on the exterior surfaces of said forefoot portion and heel, there are a plurality of spaced apart bars in a row separated from each other by channels, and, where on the interior surfaces of said forefoot portion and heel, there are a plurality parallel ridges in a row separated by recesses, each ridge being directly opposite a channel and each recess being directly opposite a bar, said bars and channels and said ridges and recesses each extending substantially at a right angle to said longitudinal axis across the width of the forefoot portion or heel as the case may be, with the thickness of the forefoot portion or heel as the case may be across each bar and recess being greater than 0.080 inch but less than 0.140 inch, and the thickness of the sole or heel as the case may be across each channel and ridge being greater than 0.025 inch but less than 0.100 inch, each bar having a width of from $\frac{1}{8}$ to $\frac{1}{2}$ inch, and each channel having a width of from $\frac{1}{8}$ to $\frac{1}{4}$ inch.

9. The overshoe of claim 8 where the bars have serrated surfaces.

10. The overshoe of claim 9 where the bars have rectangular configurations.

11. The overshoe of claim 8 where the polymeric material is polyvinylchloride.

12. The overshoe of claim 8 where the widths of the bars vary in width, with wider bars being located in a central portion of the forefoot portion.

13. The overshoe of claim 8 where the widths of the channels are essentially the same.

14. The overshoe of claim 8 where the polymeric material is translucent.

* * * * *